US006468319B1

(12) United States Patent
Yeh et al.

(10) Patent No.: US 6,468,319 B1
(45) Date of Patent: Oct. 22, 2002

(54) DIESEL FUEL CONTAINING ESTER TO REDUCE EMISSIONS

(75) Inventors: Lisa I. Yeh, Marlton; Richard H. Schlosberg, Bridgewater, both of NJ (US)

(73) Assignee: ExxonMobil Research and Engineering Co., Annandale, NJ (US)

( * ) Notice: Subject to any disclaimer, the term of this patent is extended or adjusted under 35 U.S.C. 154(b) by 0 days.

(21) Appl. No.: 09/615,248

(22) Filed: Jul. 13, 2000

Related U.S. Application Data

(60) Provisional application No. 60/144,364, filed on Jul. 16, 1999.

(51) Int. Cl.[7] ..... C10L 1/18
(52) U.S. Cl. ..... 44/388; 44/389; 44/398
(58) Field of Search ..... 44/388, 389, 398

(56) References Cited

U.S. PATENT DOCUMENTS

| | | | | | |
|---|---|---|---|---|---|
| 3,222,146 | A | * | 12/1965 | Case | 44/389 |
| 3,672,854 | A | * | 6/1972 | Rosenwald | 44/389 |
| 5,268,008 | A | | 12/1993 | Kanne | |
| 5,308,365 | A | | 5/1994 | Kesling, Jr. et al. | 44/44 |
| 5,378,249 | A | * | 1/1995 | Morrison | 44/388 |
| 5,425,790 | A | | 6/1995 | Liotta, Jr. et al. | 44/44 |
| 5,507,964 | A | * | 4/1996 | Bongardt | 44/388 |
| 5,855,628 | A | * | 1/1999 | Hashimoto | 44/308 |
| 5,880,075 | A | * | 3/1999 | Hartley | 508/501 |
| 5,882,364 | A | * | 3/1999 | Dilworth | 44/400 |
| 5,942,474 | A | * | 8/1999 | Tiffany | 508/485 |
| 5,993,498 | A | * | 11/1999 | Vrahopoulou | 44/388 |
| 6,080,212 | A | * | 6/2000 | Beimesch | 44/388 |

FOREIGN PATENT DOCUMENTS

| | | | |
|---|---|---|---|
| EP | 0626442 A1 | 11/1994 | C10L/1/02 |
| EP | 0861882 A1 | 9/1998 | C10L/1/18 |
| EP | 0905217 A1 | 3/1999 | C10L/1/02 |
| JP | 5058104 | 5/1975 | C10L/1/32 |
| JP | 627791 | 1/1987 | C10L/1/18 |
| JP | 7331262 | 12/1995 | C10L/1/18 |
| JP | 9194859 | 7/1997 | C10L/1/18 |
| WO | 9821293 | 5/1998 | C10L/1/18 |
| WO | 9828383 | 7/1998 | C10L/1/18 |

OTHER PUBLICATIONS

SAE Technical Paper Series #950400, "Emissions Characteristics of Soy Methyl Ester Fuels in an IDI Compression Ignition Engine" by J.F. McDonald, et al.
SAE Technical Paper Series #932734, "The Effect of Oxygenated Fuels on Emissions from a Modern Heavy–Duty Diesel Engine", by F.J. Liotta, Jr., et al.
SAE Technical Paper Series #962115, "Improvement of Diesel Combustion and Emissions with Addition of Various Oxygenated Agents to Diesel Fuels", by N. Miyamoto, et al.

* cited by examiner

*Primary Examiner*—Cephia D. Toomer
(74) *Attorney, Agent, or Firm*—Paul E. Purwin; George B. Georgellis

(57) ABSTRACT

This invention is a fuel composition comprising a major amount of base fuel and at least 3% w/w of an ester additive mixture derivable by reacting together either (a) (i) a saturated, aliphatic polyhydric alcohol having three or more primary alcohol groups, (ii) a C2–C15 saturated, aliphatic branched chain monohydric alcohol and (iii) a saturated, aliphatic C4–C10 dicarboxylic acid, or (b) a saturated aliphatic polyhydric alcohol having three or more primary alcohol groups with a C6–C15 saturated, aliphatic straight chain or branched chain monocarboxylic acid, or (c) a C2–C15 branched chain saturated aliphatic alcohol with a saturated, aliphatic dicarboxylic acid having 6–10 carbon atoms.

The ester additive has a boiling point ≧150° C., a molecular weight ≧200 and an oxygen content ≧13% by weight of said ester additive mixture. The additive significantly reduces particulate emissions from the exhausts of diesel powered engines.

31 Claims, No Drawings

DIESEL FUEL CONTAINING ESTER TO REDUCE EMISSIONS

CROSS-REFERENCE TO RELATED APPLICATION(S)

This application is a Non-Provisional of U.S. Ser. No. 60/144,364 filed Jul. 16, 1999.

This invention relates to fuel compositions of low sulphur content which contain at least one component capable of reducing particulate emissions from the exhausts of engines which generate power by combustion of such fuels.

Of particular interest are fuels such as diesel which are used rather widely in automotive transport and for providing power for heavy duty equipment such as, e.g., those used in underground mines due to their high fuel economy and low carbon monoxide emissions. However, one of the problems with such fuels is the pollutants in the exhaust gases of diesel powered engines and equipment. For instance, some of the most common pollutants in diesel exhausts are nitric oxide and nitrogen dioxide (hereafter abbreviated as "NOx"), hydrocarbons and sulphur dioxide, and to a lesser extent carbon monoxide and carbon dioxide. In addition, diesel powered engines also generate a significant amount of particulate emission which include inter alia soot, adsorbed hydrocarbons and sulphates, which are usually formed due to the incomplete combustion of the fuel and are hence the cause of dense black smoke emitted by such engines through the exhaust. The oxides of sulphur have recently been reduced considerably by refining the fuel, e.g., by hydrodesulphurisation thereby reducing the sulphur levels in the fuel itself and hence in the exhaust emissions. However, the presence of particulate matter in such exhaust emissions has been a more complex problem. It is known that the cause of the particulate matter emission is incomplete combustion of the fuel and to this end attempts have been made to introduce into the fuel organic compounds which have oxygen value therein (hereafter referred to as "oxygenates") to facilitate combustion. Oxygenates are known to facilitate the combustion of fuel to reduce the particulate matter. Examples of such compounds include some of the lower aliphatic esters such as eg the ortho esters of formic and acetic acid, ethers, glycols, polyoxyalkylene glycols, ethers and esters of glycerol, and carbonic acid esters. The following list of references by way of example describe the use of these compounds for reducing particulate emissions and smoke suppression:

a. Society of Automotive Engineers (SAE) Technical Paper Series No. 950400, 1995 by McDonald, J F et al entitled, "Emissions Characteristics of Soy Methyl Ester Fuels in an IDI Compression Ignition Engine".
b. Society of Automotive Engineers (SAE) Technical Paper Series No. 932734, 1993 by Liotta Jr, F J et al entitled, "The Effect of Oxygenated Fuels on Emissions from a Modern Heavy-Duty Diesel Engine".
c. Society of Automotive Engineers (SAE) Technical Paper Series No. 962115, 1996 by Noboru Miyamoto et al entitled, "Improvement of Diesel Combustion and Emissions with Addition of Various Oxygenated Agents to Diesel Fuels".
d. EP-A-0 861 882 A1
e. U.S. Pat. No. 5,425,790
f. WO-98 28383
g. WO 98 21293
h. U.S. Pat. No. 5,308,365
i. JP-A-09194859
j. JP-A-07331262 k. U.S. Pat. No. 5,268,008
l. JP-A-62007791
m. JP-A-50058104

Some of the problems with these and other oxygenated compounds are that either i) they are deficient in other required attributes, eg, boiling point range, cetane number, flash point, toxicity etc. leading to product quality issues; or
ii) they have too much oxygen in them and are hence too polar thereby making them immiscible or incompatible with the fuel; or
iii) they have too little oxygen and hence need to be added in large quantities to achieve the desired improvement in combustion and are hence incompatible with the fuel when used in such large quantities.

It has now been found that these problems can be mitigated by the use of a complex mixture of esters readily generated from commercially available carboxylic acids and hydroxy compounds and which mixture achieves the desired reduction in particulate matter in the exhausts from diesel powered engines.

Accordingly, the present invention is a fuel composition comprising in addition to the fuel at least 3% w/w of an ester additive mixture derivable by reacting together either (a) (i) a saturated, aliphatic polyhydric alcohol having three or more primary alcohol groups, (ii) a C2–C15 saturated, aliphatic branched chain monohydric alcohol and (iii) a saturated, aliphatic C4–C10 dicarboxylic acid, or
(b) a saturated aliphatic polyhydric alcohol having three or more primary alcohol groups with a C6–C15 saturated, aliphatic straight chain or branched chain monocarboxylic acid, or
(c) a C2–C15 branched chain saturated aliphatic alcohol with a saturated, aliphatic dicarboxylic acid having 6–10 carbon atoms said ester additive mixture having a boiling point of at least 150° C. and an oxygen content of at least 13% by weight of said ester additive mixture, the oxygen content being calculated based on atomic weight and molecular structure.

The fuels that may be used in and benefit by the compositions of the present invention comprise inter alia distillate fuels, and typically comprise a major amount of diesel fuel, jet fuel, kerosene or mixtures thereof. The distillate fuel itself may be a conventional petroleum distillate, or may be synthesized, e.g., by the Fischer-Tropsch method or the like. The invention is particularly applicable to diesel fuels.

The ester additive is suitably derived by reacting together either (a) (i) a saturated, aliphatic polyhydric alcohol having three or more primary alcohol groups, (ii) a C2–C15 saturated, aliphatic, straight or branched chain monohydric alcohol and (iii) a saturated, aliphatic C4–C10 dicarboxylic acid, or
(b) a saturated aliphatic polyhydric alcohol having three or more primary alcohol groups with one or more C6–C15 saturated, aliphatic straight chain or branched chain monocarboxylic acids, or
(c) a C2–C15 branched chain saturated, aliphatic monohydric alcohol with a saturated, aliphatic dicarboxylic acid having 6–10 carbon atoms under esterification conditions.

More specifically, component (i) in ester (a) is suitably selected from one or more of trimethylol ethane, trimethylol propane, monopenta-erythritol, di-pentaerythritol and tri-pentaerythritol. Technical grades of pentaerythritol generally contain a mixture of mono- (88%), di- (10–12%) and the remainder tri-pentaerythritols. Of these, trimethylol propane is preferred.

Component (ii) in ester (a) is suitably selected from one or more of 2-ethyl hexanol, n-octanol, iso-octanol, nonanol, iso-nonanol, decanol, isodecanol, undecanol, dodecanol and isotridecanol. Of these isodecanol is preferred.

Component (iii) in ester (a) is suitably a dicarboxylic acid selected from succinic acid, glutaric acid, adipic acid, sebacic acid, azelaic acid and suberic acid. Of these, adipic acid is preferred.

The esterification of an admixture of components (i), (ii) and (iii) is suitably carried optionally in the presence of an acid catalyst at a temperature in the range from 140° C. to about 250° C., and a pressure in the range from subatmospheric to atmospheric eg from about 4 KPa to about 105 KPa, over a duration of about 0.1–12 hours, preferably about 2 to 8 hours. The stoichiometry in the reactor is variable, and is capable of vacuum stripping excess reactants, especially acids, to generate a crude ester product which may be further refined by well known methods of contact with compounds capable of removing residual acidity or colour from the product to generate the desired ester mixture. Examples of such compounds capable of removing residual acidity include, activated carbon, alumina, Fuller's earth, clay, zeolites and the like.

Similarly, in ester (b) the polyhydric alcohol component may be the same as that used for making ester (a). The saturated aliphatic monocarboxylic acid component for ester (b) is suitably a monocarboxylic acid which may be produced by the so called "oxo" process by hydroformylation of commercial branched C5–C14 olefin fractions to a corresponding branched C6–C15 aldehyde-containing oxonation product. In the process for forming oxo acids, it is desirable to recover the crude oxo-aldehyde intermediate from the oxonation product and then to convert the crude oxo-aldehyde to an oxo acid by oxidation. Acids produced by this oxo process can be linear or branched and usually the branched acids contain methyl groups therein. Examples of such acids include inter alia octanoic acid, iso-octanoic acids, 2-ethyl hexanoic acid, nonanoic acid, iso-nonanoic acids, 3,5,5-trimethyl hexanoic acid, decanoic acid, 2-propyl heptanoic acid and iso-decanoic acids. In this context the expression "iso" is meant to convey a multiple isomer product made by the oxo process. In this case, the olefinic feedstream is suitably any C5–C14 olefin, preferably a branched C7 olefin although linear olefins capable of generating linear acids may also be used in the oxo process. The hydroformylation and subsequent oxidation of the crude oxo-aldehyde therefrom can produce linear and branched C6–C15 carboxylic acids, especially a mixture of branched C8 acids which usually comprises eg a mixture of isomers. Particularly preferred branched oxo acids are isooctanoic acid and 3,5,5-trimethylhexanoic acid sold respectively as Cekanoic®8 acid and Cekanoic®9 acid commercially by Exxon Chemical Company. Cekanoic®8 acid typically comprises a mixture of 3,5-dimethyl hexanoic acid, 4,5-dimethyl hexanoic acid, 3,4-dimethyl hexanoic acid, 5-methyl heptanoic acid, 4-methyl heptanoic acid and a mixture of other methyl heptanoic acids and dimethyl hexanoic acids. A mixture of Cekanoic® 8 and 9 acids can be used in a molar ratio of 1:1 to 1:10, preferably from 1:3 to 1:5 respectively.

The hydroxyl number (measured by an infra-red technique) of a 1:3 mixture is usually of the order of 69 whereas the hydroxyl number (measured by the same infra-red technique) of the 1:5 mixture is about 100–120. These compositions represent partial high hydroxyl esters wherein all of the available hydroxyl groups eg in pentaerythritol are not esterified. To derive the %conversion, the hydroxyl number is divided by 4 and subtracted from 100. Thus in the case of the mixture which contains Cekanoic® 8 and 9 acids in a ratio of 1:3, the conversion is derived by [100–(69/4)= ~83], i.e., about 83% of the available hydroxyl groups of the pentaerythritol were esterfied in this case. A mixture of esters from which the linear acids C8–C10 monocarboxylic acids can be derived occur in natural oils such as eg in coconut oil. More specifically, such a mixture of linear acids comprising 55% w/w of C8 acids, 40% w/w C10 acids and the remainder being C6 and C12 acids is available commercially from Procter & Gamble. Such mixtures of linear acids may also be used to derive the desired esters of the present invention. A particularly preferred ester is that prepared from a technical grade pentaerythritol and one or both of the Cekanoic® acids referred to above. This polyol ester can be prepared by mixing Cekanoic® 8 and 9 acids along with technical grade pentaerythritol in an esterfication reactor and heating it to a maximum temperature of 220° C. under an atmosphere of nitrogen. Any water formed in the reaction may be removed from the reaction mixture and then any unreacted acid removed by vacuum stripping. Any residual trace amounts of acids may be neutralized using a dilute sodium carbonate solution followed by flashing water overhead and a final treatment with carbon/clay mixture. The resultant product can then be filtered, e.g., through a solid such as activated carbon, Fullers earth, a zeolite, dicalite, etc., to provide the required product.

Finally in ester (c), the saturated, aliphatic monohydric alcohol having 2–15 carbon atoms is suitably selected from one or more of the group consisting of propanol, isopropanol, secondary butanol, tertiary butanol, the amyl alcohols and the hexanols. As regards the dicarboxylic acid component of the ester (c), it is substantially the same as that used in preparing ester (a) as described above. Ester (c) is preferably diisopropyl adipate.

The ester additive so formed is then admixed with the fuel to be treated in order to reduce the amount of particulate matter emitted by the exhausts of engines powered by the fuel composition.

The ester additive mixture has a boiling point of at least 150° C., suitably at least 200° C. and preferably above 250° C. in order to ensure that it is not too volatile and it does not have a low flash point. For enhancing retention and improving compatibility with the fuel, the ester admixture suitably has an average molecular weight of at least 200, preferably from 200 to 2000 and even more preferably from about 220–1000. In order to improve the potency of the additive in minimizing particulate matter formation, the ester additive mixture should have an oxygen content of at least 13% by weight, suitably at least 15% by weight and preferably more than 20% by weight of said ester additive mixture.

The ester additives most preferred are the esters:

(a) ie that derived from trimethylol propane (1.0 mole), isodecanol (3.03 moles) and adipic acid (2.75 moles) to form a complex alcohol ester (CALE ex Exxon Chemicals) having a viscosity of 165.3 cSt at 40° C. and 21.45 cSt at 100° C., and having a hydroxyl No. of 18 according to the standard method described in American Oil Chemists Society as A O C S, Cd 13-60; or (b) ie derived from technical grade pentaerythritol (5 moles), and the Cekanoic®8 acid (2.5 moles) and 3,5,5-trimethylhexanoic acid (12.5 moles) to form a high hydroxyl polyol ester having a viscosity of 177.8 cSt at 40° C. and 13.37 cSt at 100° C., and having a hydroxyl No. of 123 according to the standard method described in American Oil Chemists Society as A O C S, Cd 13-60, or (c) diisopropyl adipate.

The amount of any of the esters (a), (b) or (c) used in the compositions of the present invention is greater than 3% by weight of the total composition, is suitably greater than 5% w/w and is preferably greater than 7% w/w of the total composition. Typically, the esters are used in an amount in the range from 5 to 20% by weight, preferably from 7 to 12% by weight of the total composition. Within these ranges, it would be possible to use a relatively low amount of a specific ester if said ester has a relatively high oxygen content and conversely, one may have to use a higher amount of a particular ester if it is relatively low in oxygen content.

The ester additive used in the fuel compositions of the present invention were evaluated for their performance in reducing particulate emission using a single cylinder Caterpillar 3406 HD engine (which is a Cat 1Y450 engine) with gaseous emission analyses for: hydrocarbons, NOx, carbon monoxide, carbon dioxide, oxygen (Horiba, Mexa-9100 DEGR) and a full dilution particulate tunnel (Horiba, DLS-9200). The particulates generated in the combustion process are collected by placing a filter paper at the exit point of the dilution tunnel from which the exhaust gases emerge. The filter papers used are stabilized and weighed both before and after testing. Stabilization conditions are at a temperature of 20±2° C. and at a relative humidity of 45±10%. The difference in weight measured is taken to be the mass of particulate matter collected.

The performance of the compositions and additives of the present invention are further illustrated with reference to the following Examples and Comparative Tests:

EXAMPLES A

The ester additive used in the fuel compositions of the present invention were evaluated for their performance in reducing particulate emission using a single cylinder Caterpillar 3406 HD engine (which is a Cat 1Y450 engine) with gaseous emission analyses for: hydrocarbons, NOx, carbon monoxide, carbon dioxide, oxygen (Horiba, Mexa-9100 DEGR) and a full dilution particulate tunnel (Horiba, DLS-9200). The engine was instrumented to measure cylinder pressure, fuel line pressure and needle lift on the injector. These were captured using an AVL Indiskop high speed capture analysis system. Parameters describing the ignition and combustion can be calculated from the cylinder pressure trace. A DEC engine control system was used to monitor a comprehensive range of engine parameters. Dynamic injection timing was adjusted without stopping the engine using a mechanical system. The particulates generated in the combustion process are collected by placing a filter paper at the exit point of the dilution tunnel from which the exhaust gases emerge.

The reference fuel used as base stock in the tests conducted below was that from Esso's Fawley refinery (hereafter referred to as "LSADO") and had the following characteristics:

Density—851 kg/m$^3$

KV20 (cSt)—5.09

Sulphur content—400 ppm

T95—344° C.

Cetane Number—50

Cloud Point—−7° C.

Aromatics:

One-ring—21.1% w/w

Two-ring—13.4% w/w

Three-ring—1.9% w/w

The dimensions of the engine used for testing are shown in Table 1 below:

TABLE 1

| | |
|---|---|
| Engine | Cat 1Y540 |
| Bore (mm) | 137.2 |
| Stroke (mm) | 165.1 |
| Swept Volume (litres) | 2.43 |
| Compression ratio | 13.37:1 |
| Aspiration | Simulated turbo-charged |

The objective of the test was to evaluate each of the test fuels under the same conditions. For these tests, the dynamic injection timing was adjusted so that each fuel gave the same value as the reference fuel. In addition, all other parameters that are potentially fuel sensitive (such as eg ignition delay, exhaust temperature, etc.) were monitored and recorded. Although these parameters could not be strictly controlled during the test, they were analyzed statistically to determine whether they contributed to the observed emission effects.

The engine was run at two strictly controlled steady state test conditions, using closed loop control over speed and load. These are shown in Table 2 below:

TABLE 2

| Test Condition | Engine Speed (rpm) | Torque (Nm) | BMEP (bar) approx. |
|---|---|---|---|
| Low Load | 1500 (71%) | 60 (20%) | 3.1 |
| High Load | 1500 (71%) | 220 (75%) | 11.3 |

Values in parentheses represent the speed and load as a % of the maximum.

The particulate dilution tunnel was conditioned for at least 24 hours on each load before starting the four-day testing. Each fuel was tested four times at each load to ensure reproducibility. The engine was run at a single speed/load condition throughout a complete test day. The engine was warmed up each morning for at least 3 hours at the test conditions to stabilize the engine using a bulk fuel. Following this nine tests could be performed each day, changing to a different fuel for each test.

The time slot for each fuel involved a 5 minute fuel changeover time, 15 minutes to stabilize the engine on the new fuel. The timing was set at 5 minutes for data collection and particulate matter collection on each of two filter papers for high load testing and 10 minutes of data collection and particulate matter collection on each of two filter papers for low load testing.

The weight of the total particulate matter was calculated by weighing the filter paper before and after the test as described above. Overall reproducibility of all the emissions data was good throughout the test period with no evidence of drift in engine performance.

The following additives were tested in the amounts shown in Table 3 below in which the technical pentaerythritol ester of the branched acids (Test No. 8) was derived by reacting the pentaerythritol with a mixture of Cekanoic® 8 and 9 acids in the ratio of 1:5 by weight respectively such that the resultant ester had a hydroxyl number of 100–120 as measured by an infra-red technique. The TMP/IDA/AA ester complex is derived from trimethylol propane (1.0 mole), isodecanol (3.03 moles) and adipic acid (2.75 moles) and has a viscosity of 165.3 cSt at 40° C. and 21.45 cSt at 100° C., and a hydroxyl number of 18. In the Tables the following abbreviations have been used:

LSADO—Low sulphur automotive diesel oil (ex Esso's Fawley refinery) as base stock TMP—Trimethylol propane IDA—Isodecanol
AA—Adipic acid
ADO—Automotive diesel oil
Tech.—Technical The average molecular weights of the various esters according to the invention tested are as follows:

Disiopropyl adipate—230
TMP/IDA/AAester complex—938
Tech. Pentaerythritol branched ester (with Cekanoic® acids 8 & 9)—514 for Cekanoic® 8 acid ester and 556 for Cekanoic® 9 acid ester
Tech. Pentaerythritol linear esters (with C8–C10 linear acids)—514 for linear C8 acid ester and 598 for C10 acid ester In respect of the pentaerythritol esters, it should be noted that the structures given above are theoretical as are the molecular weights quoted and in fact, they could be mixtures of either or both of the acids esterifying the hydroxyl groups in a single molecule of pentaerythritol.

1:3 respectively) and a further set of tests was carried out on the technical grade pentaerythritol ester with linear acids derived from coconut oil comprising 55% w/w C8 monocarboxylic acids, 40% w/w C10 monocarboxylic acids and the remainder being C6 and C12 acids (available commercially from Procter & Gamble).

In this case also the test engine was a single cylinder version of the Caterpillar 3406 Heavy Duty engine referred to above in Example A. A full dilution tunnel with a primary dilution ratio of about 10:1 at high load and about 15:1 at low load was used for particulate matter collection analysis as previously.

The high load testing was carried out over 5 days of testing and the low load testing was done over 6 days. On each day of testing, all the fuels were run in a defined randomized order so that any test bias from the order of testing or the time of day would be averaged out.

The particulate dilution tunnel was conditioned for at least 24 hours on each mode before starting the six-day testing.

TABLE 3

| Test No. | Fuel Tested | Oxygenate | % w/w Oxygenate | % O in the final blend | B.P. (° C.) | Particulate Matter (g/kWh) High Load | Particulate Matter (g/kWh) Low Load |
|---|---|---|---|---|---|---|---|
| 1* | LSADO | None | — | — | — | 0.153 | 0.477 |
| 2* | LSADO | Trioxane# | 3.7 | 2 | 115 | 0.135 | 0.444 |
| 3* | " | Trimethoxy methane** | 4.4 | 2 | 102 | 0.153 | 0.439 |
| 4* | " | Di-n-propyl carbonate | 6.1 | 2 | 168 | 0.147 | 0.454 |
| 5* | " | 2-Methoxy Ethyl Ether§ | 5.6 | 2 | 162 | 0.148 | 0.440 |
| 6 | " | Di-isopropyl adipate | 7.2 | 2 | 295 | 0.144 | 0.438 |
| 7 | " | Complex Ester TMP/IDA/AA | 9.7 | 2 | >400 | 0.135 | 0.466 |
| 8 | " | Tech Pentaerythritol branched Ester | 9.4 | 2 | >300 | 0.143 | 0.484 |

*Comparative test — not according to the present invention
#Has a very low flash point (41° C.)
**Has extremely low solubility and hence very low compatibility with the fuel
§Has toxicity issues and perhaps not suitable for commercial use.

EXAMPLES B

In a further set of tests seven further fuels were tested including an LSADO base stock which was used as the reference fuel. The oxygenated fuel additives were blended into the base stock test fuels with compounds in an amount equivalent to 2% by weight oxygen in the blend. The oxygenate examples from Example A above were repeated in the case of trimethoxy-methane (also known as trimethyl ortho formate), 2-methoxy ethyl ether (also known as diglyme) and technical pentaerythritol ester with a mixture of Cekanoic® 8 and Cekanoic® 9 acids (in a weight ratio of The engine was warmed up each morning for at least 3 hours at the test conditions to stabilize the engine using a bulk fuel. The time slot for each fuel involved a 5 minute fuel changeover time, 15 minutes to stabilize the engine on the new fuel and set timing, 10 minutes of data collection and particulate matter collection on the first filter paper (Mode 1) and 10 minutes of data collection and particulate matter collection on a second filter paper (Mode 2). The total particulate matter mass obtained over the test period is shown in Table 4 below:

TABLE 4

| Test No. | Fuel Tested | Oxygenate | % w/w Oxygenate | % O in the final blend | B.P (° C.) | Particulate Matter (g/kWh) High Load | Particulate Matter (g/kWh) Low Load |
|---|---|---|---|---|---|---|---|
| 9* | Fawley low sulphur Base ADO | None | 0 | — | 282 | 0.179 | 0.400 |
| 10* | Fawley low sulphur Base ADO | Trimethoxymethane | 4.4 | 2 | 102 | 0.142 | 0.389 |
| 11* | Fawley low sulphur Base ADO | 2-methoxyethyl ether | 5.6 | 2 | 162 | 0.133 | 0.378 |
| 12 | Fawley low sulphur Base ADO | Tech. Pentaerythritol branched ester | 9.4 | 2 | >300 | 0.150 | 0.396 |

TABLE 4-continued

| Test No. | Fuel Tested | Oxygenate | % w/w Oxygenate | % O in the final blend | B.P (° C.) | Particulate Matter (g/kWh) High Load | Particulate Matter (g/kWh) Low Load |
|---|---|---|---|---|---|---|---|
| 13 | Fawley low sulphur Base ADO | Tech. Pentaerythritol linear ester | 10 | 2 | >300 | 0.146 | 0.391 |

*comparative tests not according to the invention

From the results in Examples A and B above it can be seen that the emission benefits are obtained with the compositions of the present invention without any compromises in fuel product quality issues that have been observed with additives not according to the invention.

What is claimed is:

1. A fuel composition for reducing emissions from internal combustion engines comprising a major amount of base fuel comprising diesel fuel, jet fuel, kerosene, or mixtures thereof and at least 3% w/w of an ester additive mixture derived by reacting together either (a) (i) at least one a saturated, aliphatic polyhydric alcohol having three or more primary alcohol groups, (ii) at least one a $C_2$–$C_{15}$ saturated, aliphatic straight or branched chain mono-hydric alcohol and (iii) a saturated, aliphatic $C_4$–$C_{10}$ dicarboxylic acid, or (b) at least one a saturated aliphatic polyhydric alcohol having three or more primary alcohol groups with a $C_6$–$C_{15}$ saturated, aliphatic straight chain or branched chain monocarboxylic acid, or (c) at least one a $C_2$–$C_{15}$ branched chain saturated aliphatic alcohol with a saturated, aliphatic dicarboxylic acid having 6–10 carbon atoms said ester additive mixture having a boiling point of at least 150° C. and an oxygen content of at least 13% by weight of said ester additive mixture.

2. A composition according to claim 1 wherein the distillate fuel, comprises diesel fuel, jet fuel, kerosene or mixtures thereof and the branched chain alcohol of claim (c) is a $C_8$–$C_{15}$ alcohol.

3. A composition according to claim 1 wherein the ester additive is derived by reacting together either (a) (i) a saturated, aliphatic polyhydric alcohol having three or more primary alcohol groups, (ii) a $C_2$–$C_{15}$ saturated, aliphatic, branched chain monohydric alcohol and (iii) a saturated, aliphatic $C_4$–$C_{10}$ dicarboxylic acid, or (b) a saturated aliphatic polyhydric alcohol having three or more primary alcohol groups with one or more $C_6$–$C_{15}$ saturated, aliphatic straight chain or branched chain monocarboxylic acids, or (c) a $C_2$–$C_{15}$ branched chain saturated, aliphatic monohydric alcohol with a saturated, aliphatic dicarboxylic acid having 6–10 carbon atoms under esterification conditions.

4. The composition of claim 1 wherein the saturated, aliphatic polyhydric alcohol component of ester (a) or (b) is selected from one or more of trimethylol ethane, trimethylol propane, mono-pentaerythritol, di-pentaerythritol and tri-pentaerythritol.

5. The composition of claim 1 wherein the monohydric alcohol component of ester (a) is selected from one or more of 2-ethyl hexanol, n-octanol, iso-octanol, nonanol, iso-nonanol, decanol, isodecanol, undecanol, dodecanol and isotridecanol.

6. The composition of claim 1 wherein the aliphatic dicarboxylic acid component of ester (a) is selected from one or more of succinic acid, glutaric acid, adipic acid, sebacic acid, azelaic acid and suberic acid.

7. The composition of claim 1 wherein the ester additive (a) is the reaction product of trimethylol propane, isodecanol and adipic acid under esterification conditions.

8. The composition of claim 1 wherein the saturated aliphatic monocarboxylic acid reacted with the polyhydric alcohol to form ester (b) is selected from one or more of octanoic acid, iso-octanoic acids, 2-ethyl hexanoic acid, nonanoic acid, iso-nonanoic acids, 3,5,5-trimethyl hexanoic acid, decanoic acid, 2-propyl heptanoic acid and iso-decanoic acids wherein the expression "iso" is meant to convey a multiple isomer product made by the oxo process.

9. A composition according to claim 8 wherein the ester (b) is derived from technical pentaerythritol and a monocarboxylic acid selected from iso-octanoic acids and isononanoic acids.

10. The composition of claim 1 wherein the alcohol component of ester (c) is a monohydric selected from the group consisting of propanol, isopropanol, secondary butanol, tertiary butanol, the amyl alcohols and the hexanols.

11. A composition according to claim 10 wherein the ester (c) is diisopropyl adipate.

12. The composition wherein said composition contains the ester additive in an amount from 5–20% by weight of the total composition.

13. The composition of claim 1 wherein the ester additive has an average molecular weight of at least 200.

14. A fuel composition for reducing particulate emissions from internal combustion engines comprising a major amount of base fuel and an ester additive mixture in an amount from about 5 to about 20 percent by weight of the total fuel composition said ester additive mixture derived by reacting together either (a) (i) a saturated, aliphatic polyhydric alcohol having three or more primary alcohol groups, (ii) a $C_2$–$C_{15}$ saturated, aliphatic straight or branched chain monohydric alcohol and (iii) a saturated, aliphatic $C_4$–$C_{10}$ dicarboxylic acid, or (b) a saturated aliphatic polyhydric alcohol having three or more primary alcohol groups with a $C_6$–$C_{15}$ saturated, aliphatic straight chain or branched chain monocarboxylic acid, or (c) a $C_2$–$C_{15}$ branched chain saturated aliphatic alcohol with a saturated, aliphatic dicarboxylic acid having 6–10 carbon atoms, and wherein said ester additive mixture having a boiling point of at least 150° C. and an oxygen content of at least 13 percent by weight of said ester additive mixture.

15. The fuel composition of claim 14, wherein the base fuel is selected from the group consisting of a diesel fuel, jet fuel, kerosene or mixtures thereof.

16. The fuel composition of claim 14, wherein the base fuel is diesel fuel and the branched chain saturated aliphatic alcohol of ester (c) is a $C_8$–$C_{15}$ alcohol.

17. The fuel composition of claim 14, wherein the saturated, aliphatic polyhydric alcohol of ester (a) or (b) is selected from the group consisting of trimethylol ethane, trimethylol propane, monopentaerythritol, di-pentaerythritol and tri-pentaerythritol.

18. The fuel composition of claim 14, wherein the monohydric alcohol component of ester (a) is selected from one or more of 2-ethyl hexanol, n-octanol, iso-octanol, nonanol, iso-nonanol, decanol, isodecanol, undecanol, dodecanol and isotridecanol.

19. The fuel composition of claim 14, wherein the saturated aliphatic dicarboxylic acid component of ester (a) is selected from the group consisting of succinic acid, glutaric acid, adipic acid, sebacic acid, azelaic acid and suberic acid.

20. The fuel composition of claim 14, wherein the ester additive is the reaction product of trimethylol propane, isodecanol and adipic acid under esterification conditions.

21. The fuel composition of claim 14 wherein the saturated aliphatic monocarboxylic acid reacted with the polyhydric alcohol to form ester (b) is selected from the group consisting of octanoic acid, iso-octanoic acids, 2-ethyl hexanoic acid, nonanoic acid, iso-nonanoic acids, 3,5,5-trimethyl hexanoic acid, decanoic acid, 2-propyl heptanoic acid and iso-decanoic acids wherein the expression "iso" is meant to convey a multiple isomer product made by the oxo process.

22. The composition of claim 14, wherein the ester (b) is derived from technical pentaerythritol and a monocarboxylic acid selected from iso-octanoic acids or isononanoic acids.

23. The composition of claim 14, wherein the monohydric component of ester (c) is selected from the group consisting of propanol, isopropanol, secondary butanol, tertiary butanol, the amyl alcohols and the hexanols.

24. The fuel composition of claim 14, wherein the ester (c) is diisopropyl adipate.

25. The fuel composition of claim 14, wherein the ester additive has a boiling point of at least 200° C. and an oxygen content of at least 15 percent by weight of said ester additive mixture.

26. The fuel composition of claim 14, wherein the ester additive has an average molecular weight of at least 200.

27. The fuel composition of claim 14, wherein the ester additive has a boiling point of at least 250° C. and an oxygen content of at least 20 percent by weight of said ester additive mixture.

28. The fuel composition of claim 14, wherein said ester additive is in an amount of from about 7 to about 12 percent by weight of the total fuel composition.

29. A method for reducing emissions from internal combustion engines comprising adding an ester additive mixture to a major amount of base fuel comprising diesel fuel, jet fuel, kerosene, or mixtures thereof, in an amount of at least 3 percent by weight of the fuel composition said ester additive mixture derived by reacting together either (a) (i) a saturated, aliphatic polyhydric alcohol having three or more primary alcohol groups, (ii) a $C_2$–$C_{15}$ saturated, aliphatic straight or branched chain monohydric alcohol and (iii) a saturated, aliphatic $C_4$–$C_{10}$ dicarboxylic acid, or (b) a saturated aliphatic polyhydric alcohol having three or more primary alcohol groups with a $C_6$–$C_{15}$ saturated, aliphatic straight chain or branched chain monocarboxylic acid, or (c) a $C_2$–$C_{15}$ branched chain saturated aliphatic alcohol with a saturated, aliphatic dicarboxylic acid having 6–10 carbon atoms.

30. The method of claim 29, wherein said ester additive mixture is in an amount of from about 5 to about 20 percent by weight of the fuel composition.

31. A method of reducing emissions in internal combustion engines comprising adding the fuel composition of claim 1 or 14 to the internal combustion engine.

* * * * *